US010478952B2

(12) United States Patent
Dudot

(10) Patent No.: US 10,478,952 B2
(45) Date of Patent: Nov. 19, 2019

(54) PROCESS FOR EXTRACTING SECURITY SCREW FOR WHEELS OF MOTOR VEHICLE AND EXTRACTOR FOR EXECUTING THE PROCESS

(71) Applicant: Hubitools SA, Wavre (BE)

(72) Inventor: Yannick M Dudot, Cappel (FR)

(73) Assignee: Hubitools SA, Wavre (BE)

( * ) Notice: Subject to any disclaimer, the term of this patent is extended or adjusted under 35 U.S.C. 154(b) by 159 days.

(21) Appl. No.: 15/699,608

(22) Filed: Sep. 8, 2017

(65) Prior Publication Data

US 2018/0071903 A1 Mar. 15, 2018

(30) Foreign Application Priority Data

Sep. 9, 2016 (EP) ..... 16315008

(51) Int. Cl.
*B25B 27/18* (2006.01)
*B25B 23/10* (2006.01)

(52) U.S. Cl.
CPC ..... *B25B 27/18* (2013.01); *B25B 23/108* (2013.01)

(58) Field of Classification Search
CPC ..... B25B 23/103; B25B 27/18; B25B 27/143; B25B 13/5075; B25B 13/48; B25B 23/108
See application file for complete search history.

(56) References Cited

U.S. PATENT DOCUMENTS 1,798,944 A 3/1931 Jackman
1,875,484 A 9/1932 Nigra
4,007,795 A * 2/1977 Gawron ..... B25B 21/007 173/50
5,649,791 A * 7/1997 Connolly ..... B23B 47/284 408/1 R
6,098,499 A * 8/2000 Pool ..... B25B 27/18 81/441
6,575,057 B1 * 6/2003 Ploeger ..... B25B 13/48 81/441
9,839,995 B2 * 12/2017 Kovach ..... B25B 13/48
2003/0059267 A1 * 3/2003 Deaton ..... B23B 49/026 408/201
2005/0252346 A1 * 11/2005 Kozak ..... B25B 13/065 81/53.2
2006/0060031 A1 * 3/2006 Morris ..... B25B 27/18 81/53.2
2006/0191379 A1 8/2006 McCalley

FOREIGN PATENT DOCUMENTS

DE 10201150671 A1 11/2012
DE 102012104298 A1 11/2013

OTHER PUBLICATIONS

Search Report for EP16315008.9.

* cited by examiner

*Primary Examiner* — Robert J Scruggs
(74) *Attorney, Agent, or Firm* — Christopher Casieri

(57) ABSTRACT

The invention relates to an extractor (1), a process and a set of tools for extracting a safety screw or a broken screw, consisting of inserting an extractor (1) into a hollowed bore (17) in said screw, by inserting the rod (3) of the extractor (1) into said bore (17) and by percussion on the head (7) of said extractor (1) using a percussion tool (49), so as to couple the extractor (1) and the screw (13) in rotation; and extraction of the screw (13) by loosening it using a key suitable for with the head (7) of the extractor.

17 Claims, 4 Drawing Sheets

PROCESS FOR EXTRACTING SECURITY SCREW FOR WHEELS OF MOTOR VEHICLE AND EXTRACTOR FOR EXECUTING THE PROCESS

The invention is in the field of processes and tooling for automotive mechanics and relates in particular to the processes and tools for the dismantling of vehicle wheels, for example of motor vehicles.

It is known to fix the wheel of a vehicle on its hub by means of multiple screws, one of which is a safety or an anti-theft screw. These safety screws, also known as "tamper-proof screws", have various forms. Thus, as is known, these are safety screws with a head that does not correspond to the marks of standard keys making it necessary to use a specific tool with a key adapted to the head of the safety screw in order to be able to loosen it.

This specific tool is usually present in the vehicle. However, it is possible that this tool may get lost or damaged preventing the vehicle user from changing his wheel in the event of a puncture. The user will then have to call a professional mechanic who will either have the right tool or will have to find a solution to remove this safety screw. It is also possible that the specific mark on the screw head may be damaged and therefore unusable, or that the tool has broken on the screw head and remains partly fixed to the latter such that the specific mark is no longer accessible.

One of the solutions implemented by the mechanics to nevertheless loosen the screw, and thus change the wheel, is to weld another hexagon head screw (standardised) on the safety screw head in order to rotationally couple it with the said screw. The assembly thus formed has a head that can be handled with standard tools for loosening the safety screw.

Unfortunately, this technique has several disadvantages including heat damage to the paints and varnishes of the rims or the risk of breaking the safety screw head in case of shear head screw.

Finally, this technique is unsuitable for cases in which the safety screw head is designed to rotate freely (countersunk) in the absence of a tool comprising the appropriate means for gripping said head as in the example of the safety device described in document EP2228176.

There are processes and tools for extracting of broken screws as described for example in document EP0451256. Such extractors are in the form of a threaded rod with left-hand reverse threading and generally of conical shape. They are inserted into a hole made in the screw for extracting it. Unfortunately, these solutions are not adapted to the disassembly of safety screws and particularly the safety screws used in vehicle wheels because of the fragility of their threading or their insufficient contact surface which prevents the user from applying sufficient torque to loosen said screws. The safety screws on the vehicle wheels can have a tightening torque of 160 N.m or more.

There is therefore a need for a process and tools for extracting safety screws that are adaptable to different kinds of safety screws and that can also be used in cases where the screw is broken or damaged or when the screw has a shear head or is designed to rotate freely. There is also a need for an extraction process and for tools that make it possible to extract a broken safety screw and that will not damage the components surrounding said screw. There is a need for a process and tools for extracting safety screws that are suitable for disassembling vehicle wheels and that can therefore be used with screws having high tightening torque.

The purpose of the invention is to address at least one of the disadvantages presented by the prior art by proposing a process and tools for disassembling vehicle wheels, which are universally acceptable in that they are capable of being used on safety screws of different models or which are broken.

To this end, and according to a first aspect, the purpose of the invention is a method for extracting a safety screw or a broken screw, the said screw comprising a rod, the process being noteworthy in that it comprises the following steps:

drilling a bore in the screw longitudinally using a drill with a diameter less than the diameter of the screw shaft;

fitting an extractor in the said bore, the extractor comprising a cogged rod whose cogs are in the form of longitudinal ribs and a head fixed to one of the ends of said rod, the fitting being obtained by inserting the rod of the extractor in said bore and by percussion on the head of said extractor by means of a percussion tool, so as to couple the extractor and the screw in rotation;

extraction of the screw by loosening it using a key adapted to the head of the extractor and in that: the extractor comprises a sleeve positioned at the base of its head and having a diameter greater than that of its rod and less than that of its head so as to form a shoulder with the rod and in that the pressing step (b) includes pressing the extractor rod into the screw until said shoulder is abutted against the screw (13).

According to particular embodiments, the process can comprise one or the other of the following characteristics, taken in isolation or in all possible combinations:

The drilling (a) of the bore includes the use of a drill comprising a tungsten carbide tip.

The drilling (a) of the bore is preceded by a step wherein a centring device is placed on the screw for positioning and guiding the drill bit.

The fitting (b) involves the use of a punch mandrel placed between the extractor and the percussion tool and one end of which has a mark adapted to that of the extractor head.

The extraction (c) of the screw is followed by the (d) detaching the extractor from the screw in which it has been fitted using a detachment mandrel.

As is understood from reading the definition given above, the invention consists of replacing the safety screw head or the broken head with the head of an extractor that can be handled using standard tools. To do this, the invention will couple the extractor in rotation with the screw to be loosened by forcefully pressing it into a bore made in said screw. The presence of the head and of a sleeve on the extractor forming a shoulder limits the depression of the extractor in the screw by bringing the screw head into abutment on the head of the extractor or on the shoulder formed by the sleeve. This limitation of the depression of the extractor rod makes it possible to confine the rod inside the screw and prevents contact with the wheel hub while allowing a rod of substantial length to be pressed in said screw.

According to a second aspect, the purpose of the invention is an extractor for the implementation of the process described above, for the extraction of a safety screw or a broken screw, notable in that it comprises a cogged rod whose cogs are in the form of longitudinal ribs, and a head fixed to one of the ends of said rod, and in that it comprises a sleeve placed at the base of the head, the sleeve having a diameter greater than that of the rod and less than that of the head so as to form a shoulder with the rod. The extractor is preferably made of steel.

The head is preferably hexagonal.

The extractor according to the invention is remarkable in that it makes it possible to have a straight pressing with a large contact surface with the screw to be loosened, making it possible to apply a release torque of up to 160 N.m or more for loosening the screw. The pressing of the extractor until the abutment of the head or the shoulder presented by the sleeve makes it possible on the one hand to control the length of depressing of the rod and thus force it to not exceed of the screw rod. On the other hand, the abutment makes it possible to prevent clashes when the extractor is handled which would impair its retention in the screw, the head or the sleeve being placed in support against the screw.

According to a third aspect, the purpose of the invention is a set of tools for implementing the process as described above, which is notable in that it comprises at least one extractor as defined above and one or more elements selected from:

at least one drill of diameter similar to that of the extractor rod, for drilling a bore in the screw;

one or more centring devices for positioning and guiding the drills during drilling operations;

a punch mandrel for the pressing of the extractor into a bore drilled in the screw;

an extraction mandrel for detaching the extractor from the screw in which it is fitted.

According to particular embodiments, the assembly according to the invention can comprise one or the other of the following characteristics, taken in isolation or in all possible combinations:

The assembly comprises at least one drill and at least one of the drills has a tungsten carbide tip.

The assembly comprises at least one centring device for positioning and guiding a drill bit, and at least one of the centring devices is in the form of a truncated cone through which a central duct longitudinally passes on both sides, said duct having a diameter larger than that of the drill bit and/or the extractor rod.

The assembly comprises at least one centring device for positioning and guiding a drill, and in that at least one of the centring devices is in the form of a hollow socket, with a cylindrical or truncated cone shape through which a central duct of diameter greater than that of the drill bit and/or the extractor rod passes; said central duct being in contact with an internal cavity opening out at one of the ends of the body, the mouth of the internal cavity being sized to cover the screw head; preferably, the centring device has on its end opposite that opening on the internal cavity, a bump reproducing the shape of the extractor head, with the said duct passing through said bump.

The assembly comprises at least one centring device, and at least one of the centring devices is in the form of a cylindrical body having on at least one of its ends a mark adapted to a hexagonal screw head and through which a central duct passes along its length, said duct having a diameter larger than the drill bit and/or the extractor rod. Preferably, the cylindrical body has two diametrically opposite plates. More preferably, the centring device has a mark adapted to a hexagonal head screw at each of its ends, said marks having different dimensions.

At least one of the centring devices is made of plastic material, preferably polyoxymethylene (POM).

The assembly comprises a punch mandrel, and said punch mandrel has, at one of its ends, a mark adapted to the head of the extractor.

The assembly comprises a detachment mandrel, the mandrel having at one of its ends, a fork with two teeth of increasing thicknesses between their tip and their base, and preferably the two teeth are parallel to one another and the spacing between the teeth of the detachment mandrel is less than the diameter of the extractor head.

According to a fourth aspect, the invention relates to the use of an extractor as defined above or of an assembly as defined above for the extraction of a safety screw or a broken screw on a vehicle wheel.

The invention will be well understood and other aspects and advantages will become clear from the following description, given by way of example with reference in appended drawings on which:

In the description below, the term "comprise" is synonymous with "include" and is not restrictive in that it allows the presence of other elements in the device or the vehicle to which it relates. It is understood that the term "understand" includes the words "consist of".

In the present specification, the process according to the invention will be described in parallel with the tools according to the invention for the implementation of said process.

Figure 1:
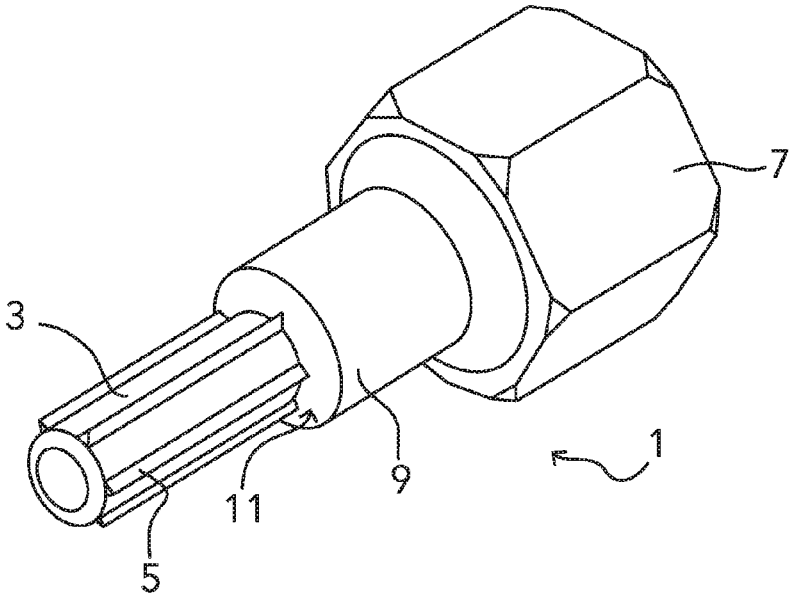
FIG. 1 shows an extractor according to the invention.

Reference will first be made to FIG. 1, which shows extractor 1 used for implementing the method of extracting a screw such as a safety screw or a broken screw. Extractor 1 according to the invention comprises a cogged rod 3 whose cogs, in the form of projecting ribs 5, extend longitudinally along the length of the rod 3, so that a transverse section of the rod shows a star-shaped pattern. Extractor 1 also has a head 7 which is preferably hexagonal so that it can be handled using standard keys. Extractor 1 is preferably made of steel. The head 7 and the rod 3 are fixed to one another irreversibly so that when the rod 3 is pushed into the screw, the head can act as an abutment to limit the depression of the extractor, and a support to avoid clashes during handling as seen below.

According to the invention, extractor 1 comprises a sleeve 9 placed at the base of the head 7 and having a diameter greater than that of the rod 3 and less than that of the head 7 so as to form a shoulder 11 with the rod 3.

The process according to the invention comprises the following steps:

drilling a bore longitudinally in the screw to be loosened using a drill with a diameter less than the diameter of the screw shaft;

fitting an extractor in the said bore, the extractor comprising a cogged rod whose cogs are in the form of longitudinal ribs and a head fixed to one of the ends of said rod, the fitting being obtained by inserting the rod of the extractor in said bore and by percussion on the head of said extractor by means of a percussion tool, so as to couple the extractor and the screw in rotation;

extraction of the screw by loosening it using a key adapted to the head of the extractor.

Figure 2:
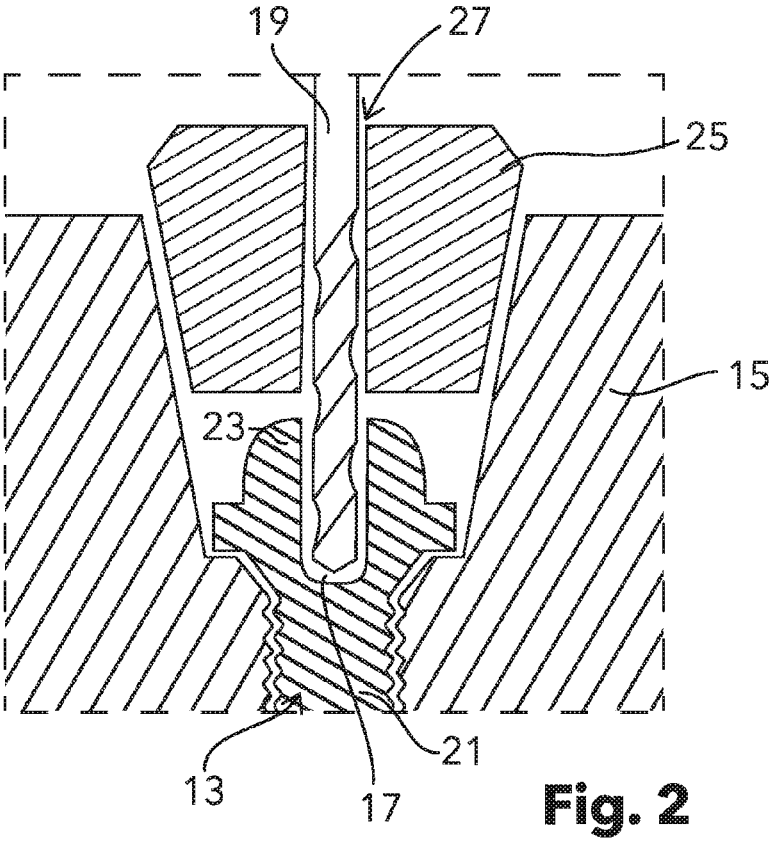
FIG. 2 is a sectional view showing the drilling of a safety screw using a drill and a centring device according to the invention.

The drilling a) of a bore is shown in FIG. 2 in the context of the extraction of a safety screw 13 called "retractable" in that it is placed at the bottom of a cavity presented by the rim 15 of the wheel. This step therefore consists of drilling a bore 17 longitudinally in the screw 13 to be loosened using a drill 19 with a diameter less than the diameter of the rod 21 of the screw 13. In the figure, the safety screw is shown with a round head 23. The drilling operation is in progress, and the bore has not yet reached the screw rod. Nevertheless, in the method according to the invention, the rod of the screw is hollowed out along all or part of its length. For example, the length of the bore made in the screw is greater than 10 mm, for example between 10 and 20 mm depending on the screw models considered. This bore length will make it possible to position an extractor whose rod has a corresponding length and which thus offers a large contact surface. This large contact surface will allow the application of sufficient torque to loosen the screw.

The drilling is carried out using a drill 19. Preferably, the drilling (a) of the bore is performed using a drill comprising a tungsten carbide tip. Such a drill may, for example, be obtained by splitting the tip of a traditional steel drill to insert a tungsten carbide insert therein. The use of such a drill facilitates the drilling of the safety screws when they are made of hardened steel.

According to the invention, the diameter of the drill is equal to the diameter of the extractor rod so that the rod can be fitted and retained in the bore hollowed out in the screw.

It will be understood that the bore 17 must be in the centre with respect to the screw head 23 since it then extends into the rod 21 of this screw. According to a preferred embodiment of the invention, and as shown in FIG. 2, the drilling (a) of the bore is carried out using a centring device 25 for positioning and guiding the drill bit.

Figure 3:
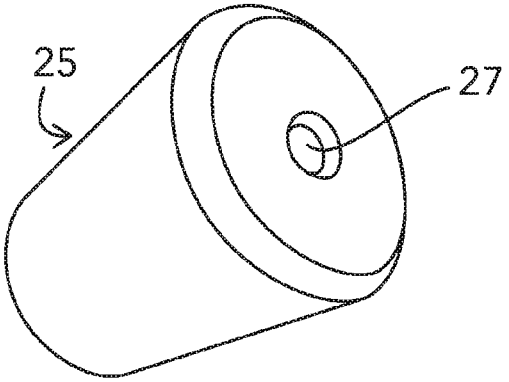
FIGS. 3 to 5 illustrate different centring devices according to the invention.

Depending on the type of screws to be loosened, the centring device may be in different shapes. In the case illustrated in FIG. 2 where the screw is a "retractable" screw as it is positioned at the bottom of a cavity presented by the rim, the centring device "with retractable screws" 25 will preferably be in the form of a truncated cone pierced by a central duct longitudinally passing through it on both sides. Such a centring device is shown in FIG. 3. The duct 27 has a diameter greater than that of the drill and is intended for the positioning and the guiding of this drill.

Figure 4:
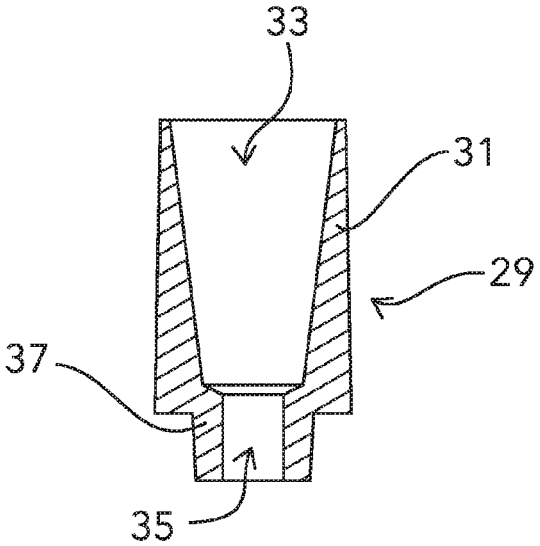

FIG. 4 shows another embodiment of a centring device 29 according to the invention for centring and guiding the drill in the case of "outbound" screws, in that they appear in relief on the rim. The centring device 29 "with outbound screws" will then be in the form of a hollow sleeve, with a cylindrical or truncated cone body 31 and a central duct 35 passing through it in contact with an internal cavity 33 opening out at one of the ends of the body 31. Preferably, the internal cavity 33 has an internal conical shape so that its diameter decreases along its length from its mouth. This configuration will allow the centring device to cover the screw head and to be retained on the latter. The central duct 35 with a diameter greater than that of the drill rod (thus the extractor rod) is used for positioning and guiding said drill. Preferably, the centring device 29 has, at the end opposite the one opening on the internal cavity 33, a bump 37 reproducing the shape of the extractor head, the said duct 35 passing through the said bump 37. This bump 37 allows the user to use a punch mandrel to position and depress the centring device 29 on the screw head.

Figure 5:
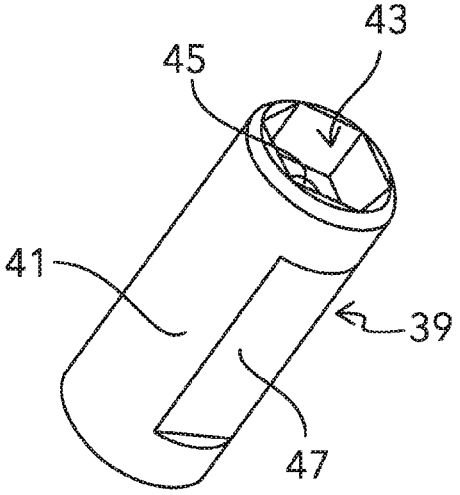

In cases where the head of the screw is mounted to rotate freely (countersunk), it will be advantageous for a person skilled in the art to use a mark centring device 39 as shown in FIG. 5. This mark centring device is in the form of a cylindrical socket 41 and, has on at least one of its ends a mark 43 of a shape adapted to a hexagonal screw head. The body 41 has a central duct 45 longitudinally passing through it on both sides. The duct 45 has a diameter greater than that of the drill rod (thus the extractor rod) and is used for positioning and guiding said drill. The mark 43 will retain the head in position and prevent it from rotating under the force of the drill during the drilling operation. Preferably, the body 31 has two diametrically opposite plates 47 to facilitate gripping and retention in position of the centring device. More preferably, the centring device has a mark adapted to a hexagonal head screw at each of its ends, said marks having different dimensions.

According to a preferred embodiment of the invention, at least one of the centring devices is made of plastic material, for example polyoxymethylene (POM), to limit the risk of damaging the paint and varnish of the rims. Nevertheless, it is also possible to make them using metallic materials.

Figure 6:
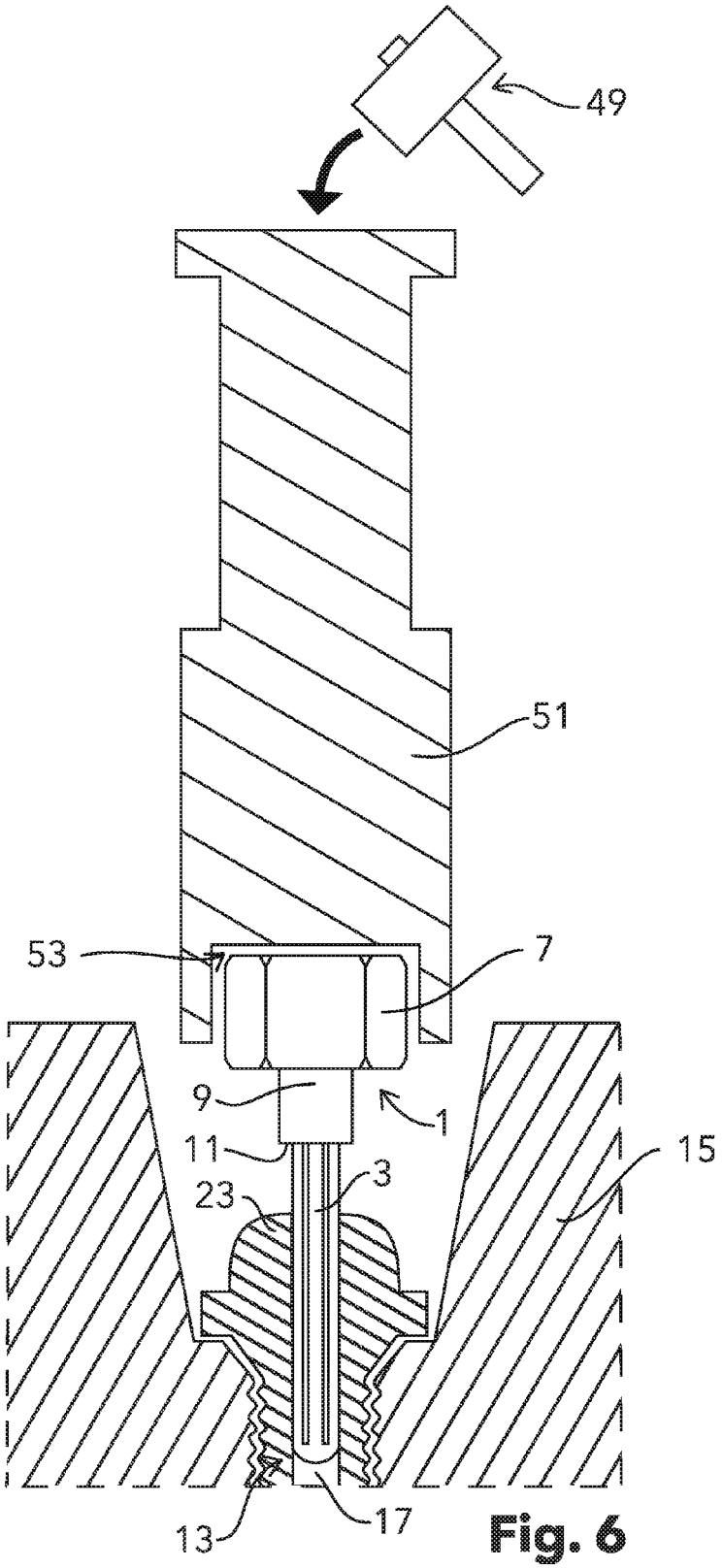
FIG. 6 shows the pressing of the extractor according to the invention.

Once the bore has been made, the extractor can be put in place according to the invention. To do this, the extractor rod is pressed into said bore during a pressing operation b) illustrated in FIG. 6. The fitting is carried out by longitudinal sliding along the bore and this sliding is generated by percussion on the extractor head by means of a percussion tool, for example a hammer. The fitting of the extractor into the screw will couple the extractor and the screw in rotation.

According to a preferred embodiment of the invention, the fitting step (b) is carried out by placing a punch mandrel 51 between the extractor 1 and the hammer 49. The punch mandrel 51 according to the invention comprises an end having a mark 53 adapted to that of the head 7 of the extractor 1. The use of such a mandrel makes it possible to hold the extractor in position for its fitting.

Preferably, extractor 1 is fitted until the base of its head comes into abutment against the head 27 of the screw or when the extractor has a sleeve 9 against the shoulder 11 formed by the sleeve 9 with the rod 3. This limitation of the depression of the extractor 1 makes it possible to ensure that the extractor rod 3 remains in the rod 21 of the screw 13. If the extractor rod protrudes from the end of the screw rod, it would attach to the wheel hub which would make the loosening of the screw more difficult.

Once the extractor is in position, the extraction of the screw by loosening it is carried out during extraction c) (not shown) using a key adapted to the extractor head. The straightness of the fitting associated with the extended contact surface makes it possible to obtain a release torque of at least 160 N.m, necessary for releasing the safety screws from the vehicle wheels.

Figure 7:
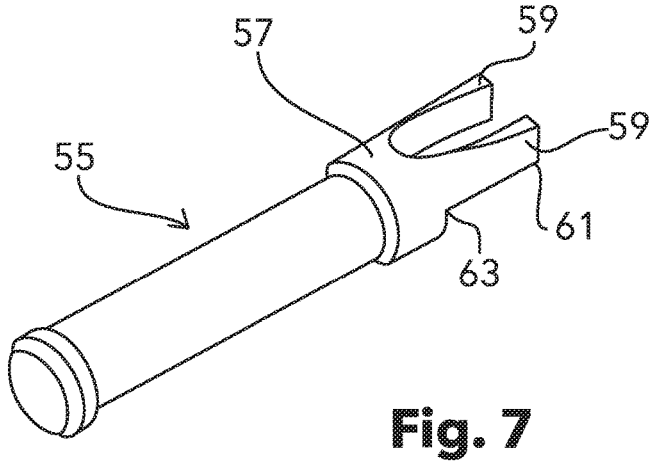
FIG. 7 shows the detachment mandrel according to the invention.

According to a preferred embodiment of the invention, the extraction (c) of the screw is followed by (d) detaching the extractor from the screw in which it has been fitted, preferably using a detachment mandrel 55 as shown in FIG. 7. The separation of the screw 13 and the extractor 1 makes it possible to reuse said extractor 1 for the extraction of another screw 13. The detachment operation can be carried out when the extractors 1 have a sleeve 9 defining a space between the head 23 of the screw 13 and the head 7 of the extractor 1.

Preferably, the detachment mandrel 55 has at one of its ends a fork 57 comprising two parallel teeth 59 of increasing thickness between their tip 61 and their base 63. The spacing between the teeth 59 of the detachment mandrel 55 is chosen to be greater than the diameter of the sleeve 9 and less than the diameter of the extractor head 7. In cases where the detachment mandrel is used with an extractor without a sleeve, the spacing between the teeth of the mandrel must be greater than the diameter of the rod of said extractor.

Figure 8:
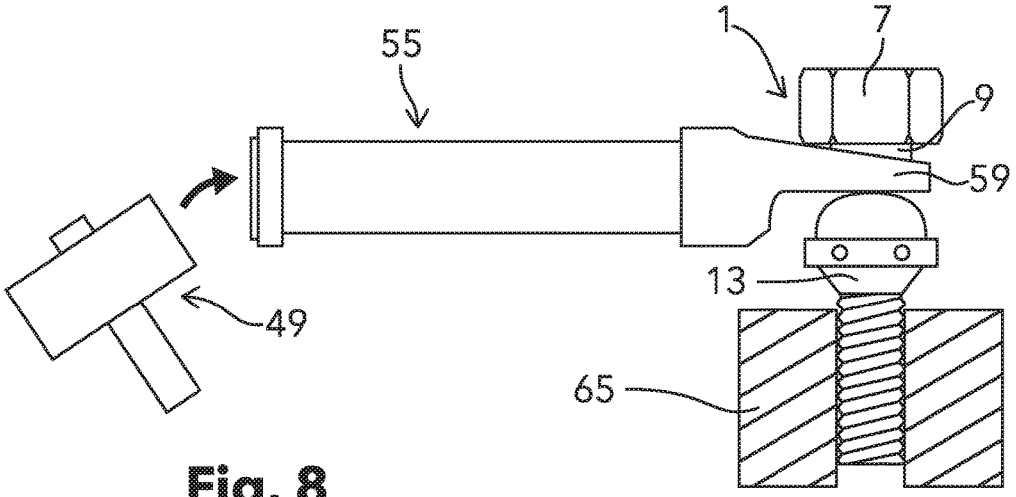
FIG. 8 shows the detachment of the extractor from the screw in which it is fitted.

Step d) is illustrated in FIG. 8. As can be seen, the screw 13 is held by the jaws 65 of a vice. The detachment mandrel 55 is positioned to place the sleeve of extractor 1 between its teeth 59. The sleeve is then pressed between the teeth 59 of the fork by percussion. Since the teeth 59 have an increasing height that is greater than the height of the sleeve at the base of said teeth, the depression of the extractor 1 will raise the extractor 1 in order to remove it in part from the screw 13.

The invention claimed is:

1. A method of extracting a safety screw or a broken screw, said screw (13) comprising a rod (21) and possibly a head (23), the method comprising the following steps:

a) drilling a bore (17) longitudinally in the screw (13) using a drill (19) with a diameter less than the diameter of the rod (21) of the screw (13);

b) fitting an extractor (1) in the said bore (17), the extractor (1) comprising a cogged rod (3) whose cogs are in the form of longitudinal ribs (5) and a head (7) fixed to one of the ends of said rod (3), wherein fitting the extractor includes inserting the rod (3) of the extractor (1) in said bore (17) and by percussion on the head (7) of said extractor (1) by means of a percussion tool (49), so as to couple the extractor (1) and the screw (13) in rotation;

c) extracting the screw (13) by loosening it using a key adapted to the head (7) of the extractor;

wherein the step of fitting an extractor (step b) includes the use of a punch mandrel (51) placed between the extractor (1) and the percussion tool (49) and one end of which having a recess (53) adapted to the head (7) of extractor (1).

2. A method according to claim 1, characterised in that the drilling (a) of the bore (17) includes the use of a drill (19) comprising a tungsten carbide tip.

3. A method according to claim 1, characterised in that the drilling (a) of the bore (17) is preceded by a step wherein a centring device (25, 29, 39) is placed on the screw (13) for positioning and guiding the drill bit (19).

4. A method according to claim 1, characterized in that the extractor (1) comprises a sleeve (9) positioned at the base of its head (7) and having a diameter greater than that of its rod (3) and less than that of its head (7) so as to form a shoulder(11) with the rod (3) and in that the pressing step (b) includes pressing the rod (3) of the extractor (1) into the screw (13) until said shoulder (11) is abutted against the screw (13).

5. A method according to claim 1, characterised in that the extraction (c) of the screw (13) is followed by the (d) detachment of the extractor (1) from the screw (13) in which it has been fitted using a detachment mandrel (55).

6. Extractor for the implementation of the process according to claim 1, characterised in that it comprises a cogged rod (3) whose cogs (5) are in the form of longitudinal ribs (5), and a head (7) fixed to one of the ends of said rod (3).

7. Extractor according to claim 6, characterized in that it further comprises a sleeve (9) placed at the base of the head (7), the sleeve having a diameter greater than that of the rod (3) and less than that of the head (7) so as to form a shoulder (11) with the rod (3).

8. Set of tools for implementing the process according to claim 1, characterised in that it comprises at least one extractor (1) according to claim 6 and one or more elements selected from:

at least one drill (9) of diameter similar to that of the rod (3) of the extractor (1), for drilling a bore (17) in the screw (13);

one or more centring devices (25, 29, 39) for positioning and guiding the drills (19) during drilling operations;

a punch mandrel (51) for the pressing of the extractor (1) into a bore (17) drilled in the screw (13);

an extraction mandrel (55) for detaching the extractor (1) from the screw (13) in which it is fitted.

9. Set of tools according to claim 8, characterised in that the assembly comprises at least one drill (19) and at least one of the drills (19) has a tungsten carbide tip.

10. Set of tools according to claim 8, characterised in that the assembly comprises at least one centring device (25) for positioning and guiding a drill bit, and in that at least one of the centring devices (25) is in the form of a truncated cone through which a central duct (27) longitudinally passes on both sides, said duct (27) having a diameter larger than that of the drill (19).

11. Set of tools according to claim 8, characterised in that the assembly comprises at least one centring device (29) for positioning and guiding a drill and in that at least one of the centring devices (29) is in the form of a hollow socket, with a cylindrical or truncated cone body (31) through which a central duct (35) of diameter greater than that of the drill (19) passes; said central duct (35) being in contact with an internal cavity (33) opening out at one of the ends of the body (31), the internal cavity being sized to cover the screw head; preferably, the centring device (29) has on its end opposite that opening on the internal cavity (33), a bump (37) reproducing the shape of the head (7) of the extractor (1), with the said duct (35) passing through said bump (37).

12. Set of tools according to claim 8, characterised in that the assembly comprises at least one centring device (39) for positioning and guiding a drill bit, and in that at least one of the centring devices (39) is in the form of a cylindrical body (41), having on at least one of its ends a mark (43) adapted to a hexagonal screw head and through which a central duct (45) passes along its length, said duct (45) having a diameter larger than the drill (19), preferably the cylindrical body has two diametrically opposite plates.

13. Set of tools according to claim 8, characterised in that the assembly comprises at least one centring device (25, 29, 39) for positioning and guiding a drill bit, and in that at least one of the centring devices (25, 29, 39) is made of plastic material.

14. Set of tools according to claim 8, characterised in that the assembly comprises a punch mandrel (51), and in that the said punch mandrel (51) has, at one of its ends, a recess (53) adapted to the head (7) of the extractor (1).

15. Set of tools according to claim 8, characterised in that the assembly comprises a detachment mandrel (55), in that the said mandrel has at one of its ends a fork (57) with two teeth (59) of increasing thickness between their tip (61) and their base (63), and preferably the two teeth are parallel to one another, and in that the spacing between the teeth (59) of the detachment mandrel (55) is less than the diameter of the head (7) of the extractor (1).

16. Use of a set of tools according to claim 8 for the extraction of a safety screw or a broken screw on a vehicle wheel.

17. Use of an extractor according to claim 7 for the extraction of a safety screw or a broken screw on a vehicle wheel.

* * * * *